United States Patent [19]

Yamazaki et al.

[11] 4,103,487

[45] Aug. 1, 1978

[54] ENGINE EXHAUST PORT LINER SYSTEM

[75] Inventors: Shuichi Yamazaki; Shinichi Shimada; Yasuhito Sato; Hiroshi Shirakura, all of Kamifukuoka, Japan

[73] Assignee: Honda Giken Kogyo Kabushiki Kaisha, Tokyo, Japan

[21] Appl. No.: 738,525

[22] Filed: Nov. 3, 1976

[30] Foreign Application Priority Data

Nov. 7, 1975 [JP] Japan ..... 50-132992

[51] Int. Cl.[2] ..... F01N 3/00; F02B 23/00

[52] U.S. Cl. ..... 60/282; 60/322; 123/193 H

[58] Field of Search ..... 60/282, 322; 123/191 A, 123/193 H

[56] References Cited

U.S. PATENT DOCUMENTS

| | | | |
|---|---|---|---|
| 3,850,453 | 11/1974 | Bentley | 60/322 |
| 3,940,927 | 3/1976 | Maurhoff | 60/322 |
| 3,969,893 | 7/1976 | Sakurai | 60/282 |
| 3,983,696 | 10/1976 | Pflugfelder | 60/282 |
| 4,018,195 | 4/1977 | Bandrowski | 123/193 H |
| 4,031,699 | 6/1977 | Suga | 123/193 H |

*Primary Examiner*—Douglas Hart
*Attorney, Agent, or Firm*—Lyon & Lyon

[57] ABSTRACT

Disclosed herein is a liner for an exhaust port system of an internal combustion engine for reducing heat loss from the exhaust gas to facilitate combustion of unburned hydrocarbons (HC) and oxidation of unburned carbon monoxide (CO). The exhaust port liner is rigidly secured at one end thereof to the exhaust port and is supported at its other end by means of a peripheral sealing ring to provide an airtight liner which is free sliding at said other end to accommodate expansion and contraction of the exhaust port liner by the exhaust gas passing therethrough.

5 Claims, 4 Drawing Figures

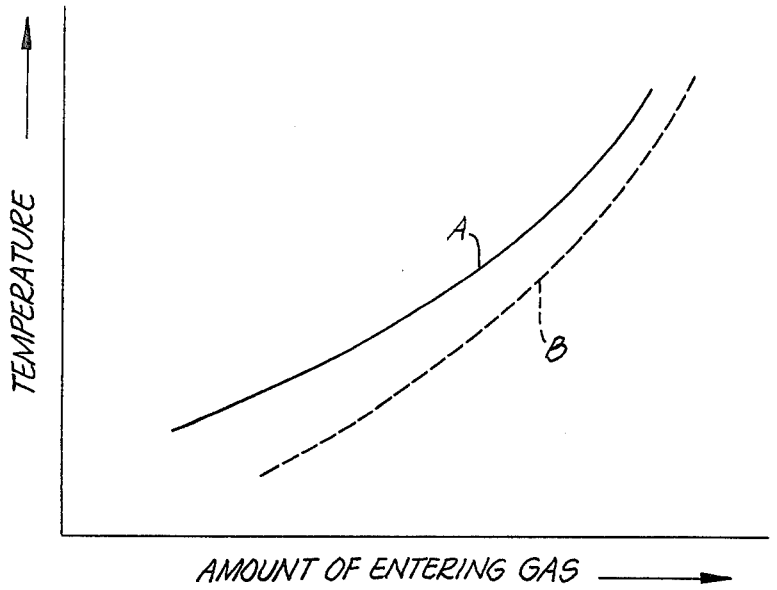
FIG. 1.
FIG. 2.
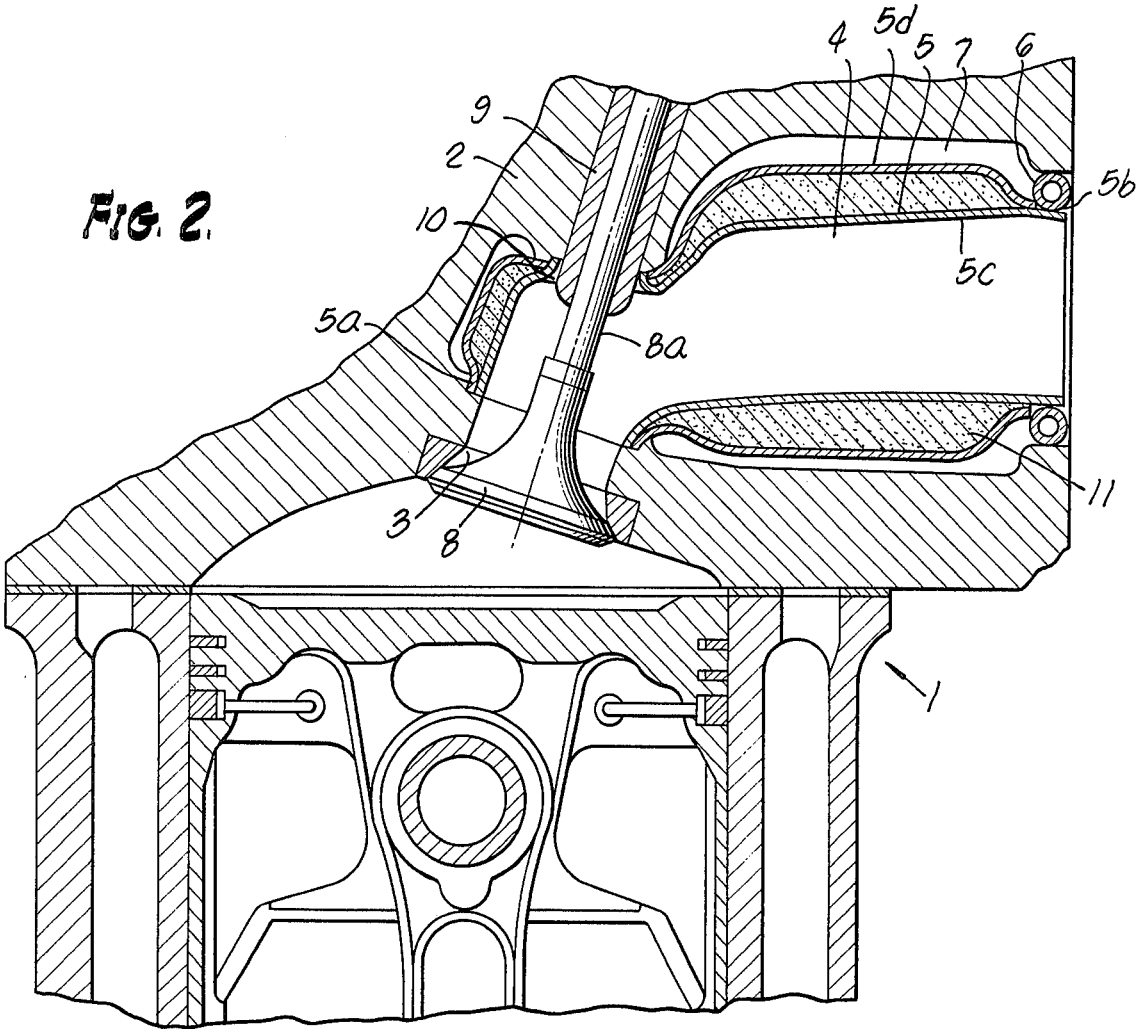

ENGINE EXHAUST PORT LINER SYSTEM

This invention relates to a liner for an exhaust port system of an internal combustion engine of the type which utilizes the heat of the exhaust gas to facilitate combustion of HC and the oxidation of CO. Heat retention in the exhaust gas is particularly important when an engine is operated on a very lean air to fuel ratio in order to supply the sufficient exothermic energy to effectuate the desired reactions. Exhaust port liners which are fixed at one end and so mounted at the other so as to be free sliding to accommodate the expansion of the exhaust port liner by the exhaust gas are known in the art. However, exhaust port liners form an insulating space between the liner and the exhaust port and if that space is not airtight, the exhaust gas is likely to enter the space through any available gap and convect heat to the outer port liner wall and the inner exhaust port wall, and the heat of the inner exhaust port wall is then dissipated through the cylinder head. The result of this convective heat loss is a lower temperature in a reaction chamber to which the exhaust port liner is communicated, decreases the efficiency of the reaction in the reaction chamber and increases the CO and HC content in the exhaust emissions from the reaction chamber. In those exhaust port liners heretofore available, the free sliding ends of the liners have not provided airtight seals with the exhaust ports resulting in the aforesaid heat loss and increased emissions.

The present invention is intended to provide a liner for an exhaust port system which has one end freely sliding to accommodate the expansion of the liner by the exhaust gas while maintaining both ends of the liner in continual airtight relationship with the exhaust port to prevent gas from passing about the liner into the insulating space with the resulting heat loss and increased emissions. Other and more detailed objects and advantages will appear hereinafter.

In the drawings:

FIG. 1 is a graph illustrating the correlation in conventional port liner systems between the increased temperature in the port liners and exhaust ports and the amount of exhaust gas entering the insulating space between the liner and port wall.

FIG. 2 is a sectional view illustrating one embodiment of the invention.

Figure 3:
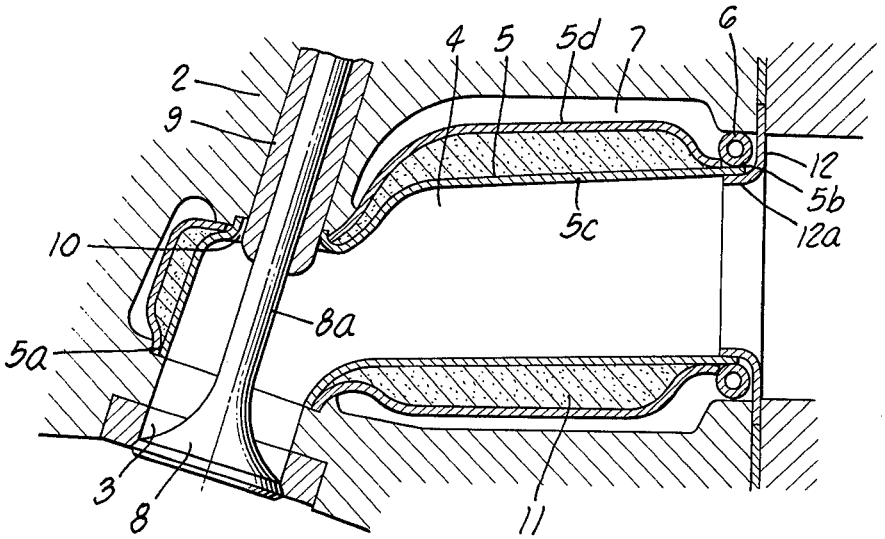
FIG. 3 is a sectional view illustrating a second embodiment of the invention.

Referring now in detail to the drawings, FIG. 1 illustrates the temperature increase in the outer port liner walls A and inner exhaust port walls B which occurs in the port liner systems heretofore available as the amount of gas entering the insulating space between the liner and port wall increases. As can be seen, as the amounts of gas entering the insulating space increases, so does the temperature and accordingly, heat loss through convection. In the embodiment of the present invention illustrated in FIG. 2, an internal combustion engine 1 is shown having a cylinder head 2 with an exhaust valve port 3 therein communicating with an exhaust port 4. Exhaust port liner 5 is cast at its inner upstream end **5*a* into the exhaust port 4 such that it forms a rigid airtight seal with the exhaust valve port 3. A sealing ring 6, which is preferably hollow and constructed of an elastic, metallic material, is disposed about the free end 5*b* of the port liner 5 between the port liner 5 and exhaust port 4 to form an airtight seal therebetween and define an airtight insulating space 7 about the port liner 5**.

An exhaust valve 8 having a stem portion **8*a* is disposed against the exhaust valve port 3 and is slidably mounted in a guide cylinder 9 which extends through an installation aperture 10 in the upper side of the port liner 5 and is carried by the cylinder head 2. When being cast, the installation aperture 10 is in close contact with the internal surface of the exhaust port 4 to maintain the insulating space 7** in an airtight disposition.

As seen in the drawings, the port liner 5 is comprised of an inner wall portion **5*c* and an outer wall portion 5*d*. This construction allows an insulating material 11, preferably a ceramic material, to be disposed therebetween and reduce heat lost from the exhaust within the exhaust port 4. As the engine 1 is driven and the port liner 5 is heated by the exhaust gas and caused to expand, the sealing ring 6 mounting the free end 5*b* of the port liner 5 allows said end 5*b* to slide on the sealing ring 6 to accommodate such expansion while maintaining an airtight seal between the liner 5 and exhaust port 4 thereby preventing any of the exhaust gas from entering the space 7 and being cooled by the cylinder head 2. In this manner, the high temperature of the exhaust gas is maintained for the efficient reduction of CO and HC in the downstream reaction chamber (not shown). It should additionally be noted that the aforesaid sealing ring 6 mounting the port liner 5 is capable of maintaining this airtight relationship while undergoing vibration caused by the engine 1**.

A second embodiment of the invention is illustrated in FIG. 3 wherein a flange 12 having a projecting collar **12*a* is rigidly affixed to the cylinder head 2 such that the projecting collar 12*a* is disposed over the extended end 5*b* of the port liner 5** to provide further resistance against the vibration.

Figure 4:
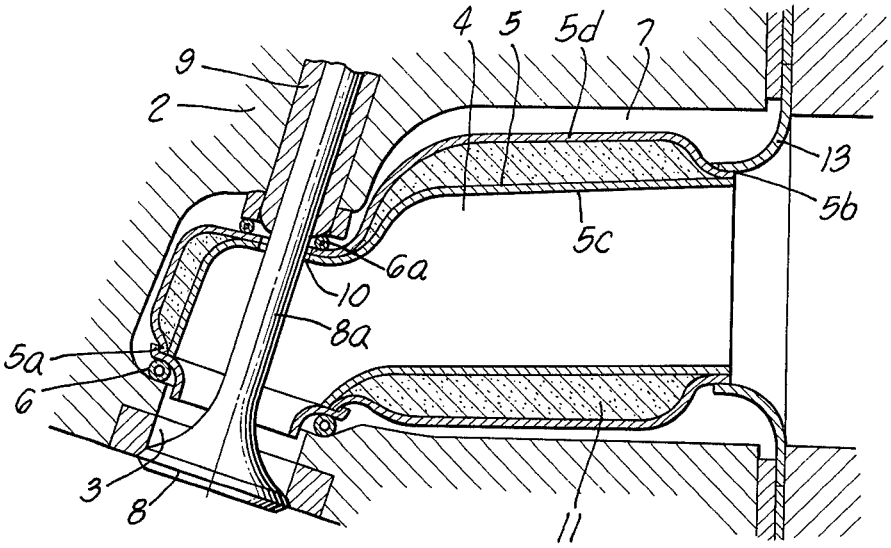
FIG. 4 is a sectional view illustrating a third embodiment of the invention.

FIG. 4 illustrates a third embodiment in which the extended end **5*b* of the port liner 5 is attached to the cylinder head 2 by means of a flange 13 which is secured to the liner 5 and the cylinder head 2 by welding or other suitable means to provide an airtight seal with the exhaust port 4. A sealing ring 6 is disposed at the innermost end 5*a* of the port liner 5 between the port liner 5 and the exhaust valve port 3. Under expansion and contraction the port liner 5 slides on the sealing ring 6 while maintaining the airtightness of the insulating space 7. A second sealing ring 6*a* is placed between the port liner 5 and the internal wall of the exhaust port 4 about the periphery of the installation aperture 10 and the stem 8*a* of the exhaust valve 8 thereby allowing additional sliding movement of the port liner 5 about the stem 8*a*** while maintaining an airtight relationship therewith.

Through the use of the above described exhaust port liners, the liner can expand and contract in a substantially airtight relationship with the exhaust port to minimize heat dissipation to the cylinder head allowing the exhaust gas to be fed to the reaction chamber at a high temperature for the efficient reduction of CO and HC. Because of the utilization of hollow, metallic sealing rings 6 and **6*a***, heat conduction therefrom is quite small further minimizing heat loss from the exhaust gas.

Various changes and modifications may be made in carrying out the present invention without departing from the spirit and scope thereof. Insofar as these changes and modifications are within the purview of the appended claims they are to be considered as part of the invention.

We claim:

1. An engine exhaust port liner system comprising a liner rigidly affixed at one end thereof to the exhaust port and being spaced therefrom to define an insulating space between said liner and said exhaust port and a sealing ring disposed about the other end of said liner between said liner and said exhaust port for slidably mounting said other end of said liner on said exhaust port while continually maintaining said insulating space in a substantially airtight disposition during sliding movement of said other end on said exhaust port, wherein said sealing ring is hollow, has a circular cross-section, and is constructed of an elastic, metallic material.

2. An engine exhaust port liner system comprising a liner rigidly affixed at the upstream end thereof to the exhaust port and being spaced therefrom to define an insulating space between said liner and exhaust port, a sealer ring disposed about the down stream end of said liner between said liner and said exhaust port for slidably mounting said down stream end of said liner on said exhaust port while continually maintaining said insulating space in a substantially air-tight disposition during sliding movement of said down stream end on said exhaust port, and flange means carried by the engine cylinder head for supporting said down stream end of said portliner by means of a projecting collar thereof inserted into said portliner.

3. An exhaust port liner for an internal combustion engine comprising a liner, flange means carried by the engine cylinder head for securing the downstream end of said liner in an airtight relationship with said exhaust port and a first sealing ring disposed about the upstream end of said liner between said liner and the engine exhaust port such that said liner is free to slide on said ring while continually maintaining a substantially airtight seal therewith.

4. The combination of claim 3 wherein an aperture is provided in said liner to accommodate an engine exhaust valve and including a second sealing ring disposed between said liner and said exhaust port about a portion of said exhaust valve.

5. An engine exhaust port liner system comprising a liner rigidly affixed at one end thereof to the exhaust port and being spaced therefrom to define an insulating space between said liner and said exhaust port, said liner being constructed of inner and outer walls, a sealing ring disposed about the other end of said liner between said liner and said exhaust port for slidably mounting said other end of said liner on said exhaust port while continually maintaining said insulating space in a substantially air-tight disposition during sliding movement of said other end on said exhaust port, and said sealing ring is hollow, has a circular cross-section, and is constructed of an elastic, metallic material.

* * * * *